US005147220A

United States Patent [19]

Lybrand

[11] Patent Number: 5,147,220

[45] Date of Patent: Sep. 15, 1992

[54] BOARD MOUNTED SHIELDED ELECTRICAL CONNECTOR

[76] Inventor: Brent B. Lybrand, 216 Seven Oaks La., Spartanburg, S.C. 29301

[21] Appl. No.: 707,725

[22] Filed: May 30, 1991

[51] Int. Cl.[5] ..... H01R 13/73; H01R 13/648

[52] U.S. Cl. ..... 439/567; 439/607

[58] Field of Search ..... 439/82, 554, 557, 567, 439/571, 607, 108, 609

[56] References Cited

U.S. PATENT DOCUMENTS

| | | | |
|---|---|---|---|
| 4,506,937 | 3/1985 | Cosmos et al. | 439/101 |
| 4,512,618 | 4/1985 | Kumar | 439/95 |
| 4,518,209 | 5/1985 | Negley | 439/92 |
| 4,679,883 | 7/1987 | Assini et al. | 439/607 |
| 4,717,219 | 1/1988 | Frantz et al. | 439/82 |
| 4,721,473 | 1/1988 | Del Guidice et al. | 439/79 |
| 4,802,860 | 2/1989 | Kikuta | 439/79 |
| 4,808,125 | 2/1989 | Waters et al. | 439/607 |
| 4,854,890 | 8/1989 | Nishimura | 439/607 |
| 4,865,555 | 9/1989 | Assini et al. | 439/82 |
| 4,889,502 | 12/1989 | Althouse et al. | 439/607 |
| 4,902,242 | 2/1990 | Davis et al. | 439/607 |
| 4,911,659 | 3/1990 | Viselli | 439/570 |
| 4,943,244 | 7/1990 | Teck et al. | 439/571 |
| 5,024,607 | 6/1991 | Kachlic | 439/554 |

OTHER PUBLICATIONS

Holmberg Catalog, "Product Line Catalog", cover sheet, pp. 42 and 55, undated.

*Primary Examiner*—Gary F. Paumen

[57] ABSTRACT

A shielded right angle D-faced connector is provided for mounting on a printed circuit board and for attachment to a complementary electrical connector. The connector comprises an insulator of insulative material supporting a plurality of electrical contacts each formed to have a right angle terminal pin for soldering to the printed circuit board. The connector further comprises a conductive shell supported on the insulator for shielding the contacts. Two one-piece, die-cast metal latching blocks are provided at the respective ends of the connector, each latching block including latching members for attaching to the complementary connector. Each latching block includes keying elements for cooperative engagement with the insulator body to provide proper alignment and anti-rotation resistance thereto. Two conductive locking clips are included, each clip being supported by the insulator body and secured electrically to the conductive shell to provide an electrical grounding pair thereto. Each locking clip comprises a bend-resistant element in a manner to resist bending of the clip during application to a printed circuit board to assure proper mounting and seating to the board.

19 Claims, 5 Drawing Sheets

BOARD MOUNTED SHIELDED ELECTRICAL CONNECTOR

FIELD OF THE INVENTION

The present invention relates to an electrical connector, and more particularly, to a shielded electrical connector for mounting on a printed circuit board and for attachment to a complementary electrical connector.

BACKGROUND OF THE INVENTION

Right angle D-faced electrical connectors are used in the electronics industry as an input/output (I/O) device to interconnect a computer to external peripheral equipment. The contacts of the electrical connector are typically soldered to conductive traces on a printed circuit board at a back wall or panel of the computer. A conductive shell surrounding the contacts in the housing of the connector is frequently used as a shield to protect against electromagnetic or radio frequency interference (EMI/RFI). A conductive locking clip is often used to retain the connector on the printed circuit board for soldering the contacts by a conventional wave soldering process. The locking clip further serves as a means to connect a ground trace on the printed circuit board to the conductive shell of the connector. The front face of the connector, in addition to having the D-face for polarization, typically includes latching structure for mating with a complementary electrical connector which is attached to the peripheral equipment.

With respect to such latching structure, as disclosed in U.S. Pat. No. 4,808,125 (Waters, et al), due to the prospect of repeated mating and unmating of the right angle D-connector to the complementary connector, it is preferable that the latches on the connector be formed of metal, such as a cast metal, rather than plastic which may be susceptible to failures. In the Waters, et al patent, not only the latches, but the entire connector housing is integrally formed of a cast metal, thus complicating the shielding of the electrical contacts in the connector. Individual metal latching blocks, for example, as disclosed in U.S. Pat. No. 4,506,937 (Cosmos, et al) are also used for attachment to a mating complementary connector. While individual latching blocks may be more cost effective and less complicated than a one-piece housing with latches, attention must be provided in securing the latching blocks to the connector in a manner that would properly align its latches and prevent rotation thereof so that attachment to the complementary connector may be properly made.

As to the locking clip that is used as a ground commoning element and as a means to retain the connector to a printed circuit board during contact soldering, such a clip is shown, for example, in U.S. Pat. No. 4,721,473 (DelGuidice, et al). It is noted by DelGuidice, et al that alignment of the connector on the printed circuit board is desirable in order to properly interconnect to the mating complementary connector without placing undue stress on the circuit board connections. In this regard, the locking clip typically includes resiliently deformable legs that are frictionally received in openings in a printed circuit board. Due to the resistive force accompanying the insertion of the resilient legs into the board openings, it is desirable to prevent the locking clip from experiencing excessive bending that would result in misaligned or improper mounting of the connector to the printed circuit board.

SUMMARY OF THE INVENTION

It is an object of the present invention to provide an improved shielded electrical connector.

It is a further object of the present invention to provide a shielded electrical connector having an improved latching block for attachment to a complementary electrical connector and an improved locking clip for mounting on a printed circuit board.

In accordance with a preferred form of the invention, a shielded electrical connector comprises an insulator of insulative material including a body and two spaced ear portions, each ear portion projecting outwardly from the body and comprising a mounting wall and a base. An opening is formed through the mounting wall. The body has a plurality of apertures therein supporting a respective plurality of electrical contacts. A conductive shell is supported on the insulator body and comprises two spaced flanges. Each flange has a surface disposed adjacent a respective insulator mounting wall and has an opening therethrough in substantial registry with the respective opening in the insulator mounting wall. The connector further includes two one-piece, metal latching blocks for attachment to a complementary electrical connector. Each block is disposed adjacent a respective flange of the shell. Each block further comprises a generally flat plate having opposed surfaces and a latching member projecting outwardly from one of the surfaces in a direction away from the shell flange. A bushing projects from the opposite plate surface, the bushing extending through the opening in the shell flange and through the opening in the mounting wall of the ear portion. The bushing has as an internally threaded aperture opening through the surfaces of the flat plate. A keying element projects from each block toward a respective ear portion mounting wall and is engagement therewith for aligning each block relative to the shell flange and for providing anti-rotation resistance thereto. The keying element is spaced from the bushing and is of configuration lying within the periphery of the mounting wall. Two conductive locking clips are supported by the insulator base. Each clip has a securement portion secured to a respective bushing and a resilient latching portion projecting outwardly from the base for resilient mounting to an electrical circuit on a printed circuit board.

In accordance with another aspect of the invention, a shielded electrical connector comprises an insulator of insulative material including a body and two spaced ear portions, each ear portion projecting outwardly from the body and comprising a base and a mounting wall. The body has a plurality of apertures therein supporting a respective plurality of electrical contacts. A conductive shell is supported on the insulator body and comprises two spaced flanges, each flange having a surface disposed adjacent a respective insulator mounting wall. Two one-piece, metal latching blocks are provided for attachment to a complementary electrical connector. Each block is disposed against a respective flange of the shell, and comprises a latching member projecting outwardly therefrom. Further included in the connector are two conductive locking clips supported by the insulator base. Each clip has a securement portion attached electrically to the shell and a resilient latching portion projecting outwardly from the base for resilient mounting to an electrical circuit on a printed circuit board. The clip further includes means providing bend resistance upon mounting of the clip to the printed circuit board.

DETAILED DESCRIPTION OF THE PREFERRED EMBODIMENTS

Figure 1:
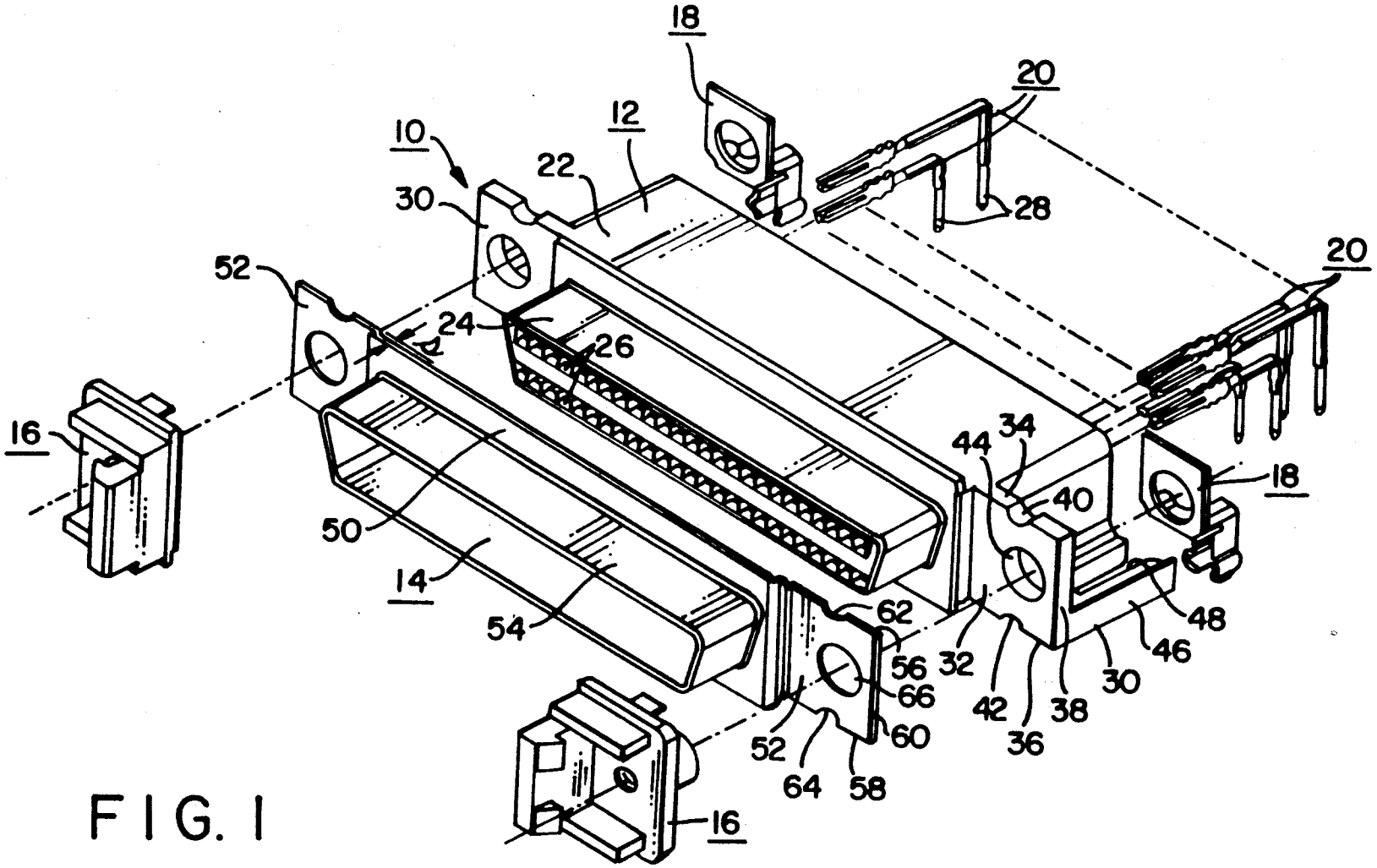
FIG. 1 is an exploded, top perspective view of a shielded electrical connector in accordance with a preferred embodiment of the invention.
Figure 2:
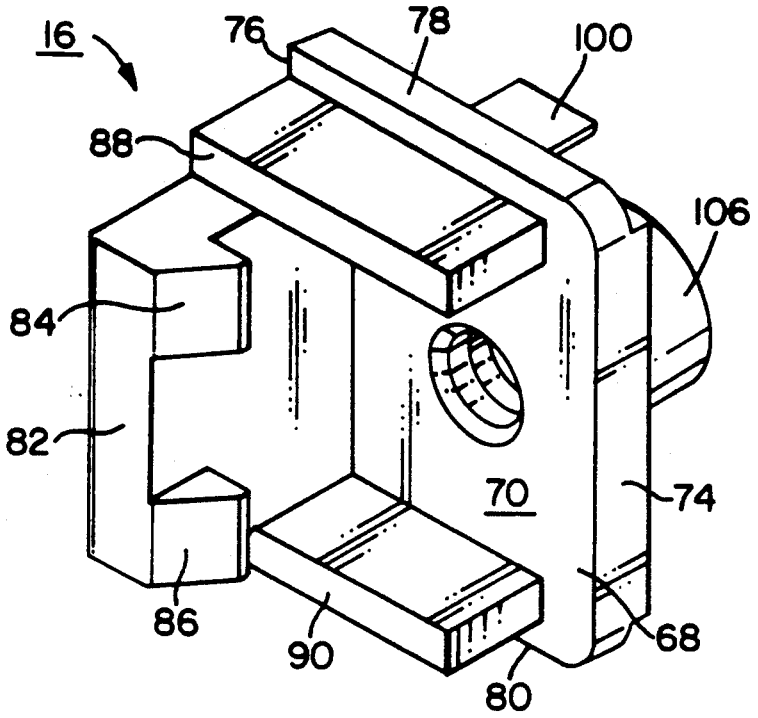
FIG. 2 is a front, perspective view of a one-piece, latching block for particular use in the electrical connector of FIG. 1.

Turning now to the drawing figures, there is shown in FIG. 1 a right angle D-faced shielded electrical connector 10 for mounting on a printed circuit board and for attachment to a complementary electrical connector. Connector 10 basically comprises an insulator 12, a conductive shell 14, a pair of metal one-piece latching blocks 16, a pair of conductive locking clips 18 and a plurality of right angle electrical contacts 20.

The insulator 12 is formed of insulative material, preferably being a molded thermo-plastic material and comprises a generally elongate body 22. Projecting outwardly from the front surface of the body 22 is a nose portion 24 configured in the industry standard D-configuration for polarization purposes. Extending through the nose portion and the insulator body 22 are a plurality of apertures 26 which open through the front surface and the rear surface (not shown) of the body 22. In the arrangement shown, there are two rows of 25 apertures each, each aperture being spaced 0.05 inch within a row, and the upper and lower row being spaced 0.100 inch. It should be appreciated that different numbers of apertures at different spacings may also be used within the context of the invention. The electrical contacts 20, each having a right-angle bend, are received respectively in the apertures 26 and are supported in the insulator body 22. The contacts 20 each include a terminal pin 28 for receipt in openings in a printed circuit board (not shown) for subsequent soldering thereto so as to electrically interconnect the connector 10 to electrical circuits on the printed circuit board.

Insulator 12 includes a pair of ear portions 30 projecting outwardly from the respective ends of the body 22. Each ear portion 30 comprises a generally planar mounting wall 32 defined by an upper edge 34 and a lower edge 36 that are substantially parallel to each other and an interconnecting outer edge 38 that is substantially perpendicular to the upper and lower edges respectively. Extending into the upper edge 34 is a curved recess 40 and extending into the lower edge 36 is a similarly configured curved recess 42. The upper recess 40 and the lower recess 42 are preferably aligned with each other in a plane generally parallel to the outer edge 38. As will be described hereinafter, recesses 40 and 42 provide keyways for keying the latching block 16 upon assembly of the blocks 16 to the insulator 12. Extending through the mounting wall 32 of each ear portion 30 is an opening 44. In the preferred arrangement, the recesses 40 and 42 are aligned closer to the body 22 than is the central axis of the opening 44. Each ear portion further includes a base 46 extending rearwardly from a respective mounting wall 32, each base 46 having an opening 48 therethrough for retentive receipt of a respective locking clip 18 therein.

Referring still to FIG. 1, the conductive shell 14 comprises a generally elongate, planar frame 50. Projecting outwardly from the ends of the frame 50 is a pair of generally planar flanges 52, each of the flanges being substantially parallel to the frame 50 and being offset rearwardly with respect to the frame 50 by a spacing, s. Extending outwardly from the front of the frame 50 is a continuous nose section 54 configured in complementary form to the D-shape nose portion 24 and adapted form surrounding receipt thereon.

Each flange 52 is defined by an upper edge 56 and a lower edge 58 that are substantially parallel and an outer edge 60 that joins the upper and lower edges 56, 58 and is substantially perpendicular thereto. A curved upper recess 62 extends into the upper shell edge 56 and a lower curved recess 64 extends into the lower shell edge 58. An opening 66 extends through each flange 52. Upon attachment of the shell 14 to the insulator 12, the flanges 52 are formed to lie against the respective ear portions 32, the flange recesses 62 and 64 being formed to lie in substantial registry with the recesses 40 and 42 in the mounting wall, and the flange opening 66 to lie in substantial registry with the opening 44 in the mounting wall. In the preferred embodiment, the shell 14 is a drawn steel shell which provides protection against electro-magnetic interference (EMI) and radio frequency interference (RFI) for the contacts supported in the insulator 12. Further, as will be described, the shell 14 may be electrically commoned to a ground trace on a printed circuit board by the conductive locking clips 18.

Turning now also to FIGS. 2 through 5, the details of the latching block in accordance with a preferred form of the invention may be more fully understood. Each block 16 is formed as an integral, one-piece block of metal, preferably a die-cast metal, such as zinc. Each block comprises a substantially flat plate 68 including a front planar surface 70 and a rear planar surface 72. Each flat plate is defined by spaced, opposing substantially parallel side edges 74 and 76 and spaced, opposing end edges 78 and 80. Side edges 74 and 76 together with end edges 78 and 80 define a substantially rectangular shape of flat plate 68.

Projecting outwardly from the front surface 70 is a latching member 82 defined by a pair of spaced, latching teeth 84 and 86, each having an inclined outer surface. The latching teeth are adapted to engage a latch of a complementary connector (not shown) in snap-action fashion to secure each of the latching blocks 16 to such complementary connector. Each latching block 16 may further include a pair of substantially parallel, spaced ledges 88 and 90 projecting from the front surface 70, each ledge 88, 90 serving as guide members in the attachment to a complementary connector.

Figure 4:
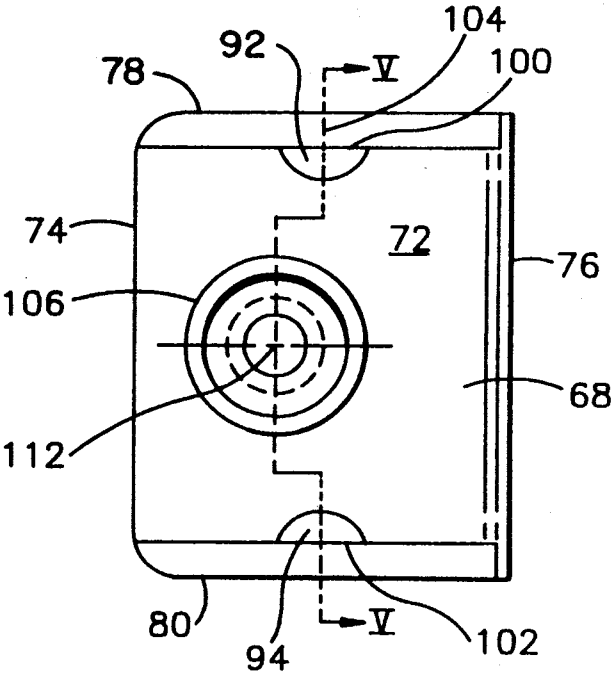
FIG. 4 is a rear elevation view of the latching block of FIG. 3.

Projecting rearwardly from the rear surface 72 of each latching block 16 is a pair of keying elements 92 and 94 that are formed to lie within the periphery of the flat plate 68. Each latching element 92, 94 is respectively formed to have a keying surface 96, 98, such keying surfaces being configured for cooperative engagement with the recesses 40 and 42 in the mounting wall 32 of the insulator body 22. In the preferred arrangement, the keying surfaces 96 and 98 are formed to be non-linear and are generally of semi-circular, curved shape. Adjacent the respective upper and lower end edges 78 and 80, each keying element includes a substantially flat surface 100, 102 that are within the respective end edges 78 and 80 and are substantially parallel thereto. As illustrated in FIG. 4, the keying elements 92 and 94 lie adjacent the end edges 78 and 80 and the centers of the keying elements lie in a plane 104 that is substantially parallel to the side edges 74 and 76.

Figure 3:
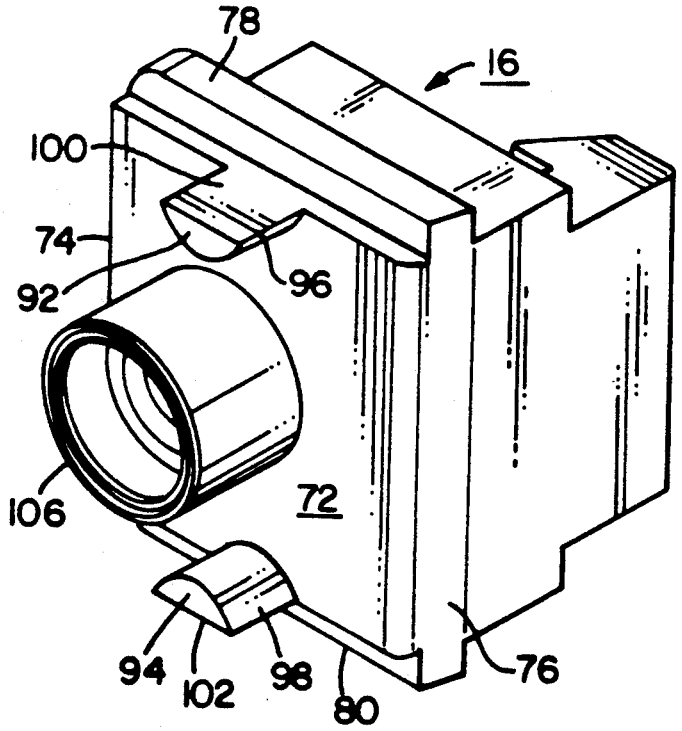
FIG. 3 is a rear, perspective view of the latching block illustrated in FIG. 2.
Figure 5:
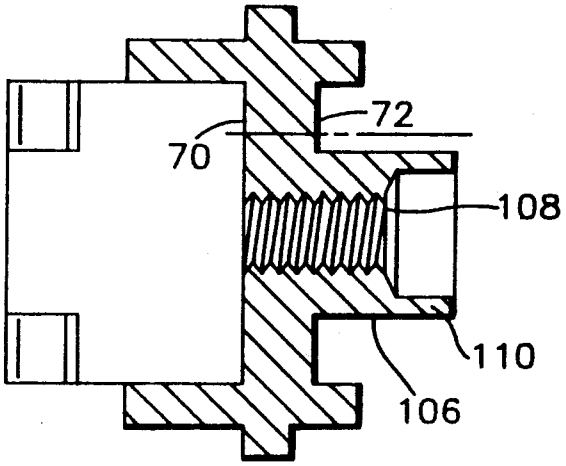
FIG. 5 is a cross-sectional view of the latching block of FIG. 4 as seen along viewing lines V—V.

As seen in FIG. 3, a bushing 106 of generally cylindrical outer configuration projects outwardly from the rear surface 72 of each latching block 16. As seen further by reference to FIG. 5, the bushing 106 includes an internally threaded aperture 108 that opens through the front surface 70 and the rear surface 72. At its rearward distal end, bushing 106 includes a relatively thin wall 110 that is particularly configured for swaging in a peening process for attachment to the connector locking clip, as will be described hereinafter.

By further reference to FIG. 4, bushing 106 has a central axis 112 that is substantially perpendicular to the flat plate 68. The axis 112, and thereby the bushing 106, is located closer to side edge 74, the axis 112 thereby being off-set laterally relative to the plane 104 of the latching elements 92 and 94. The axis 112 and thereby the bushing 106 may also be offset such that it lies closer to side edge 76. The off-set of the bushing 106 relative to the keying elements 92 and 94 is configured cooperatively with the off-set spacing of the mounting wall opening 44 and upper and lower recesses 40 and 42.

Figure 6:
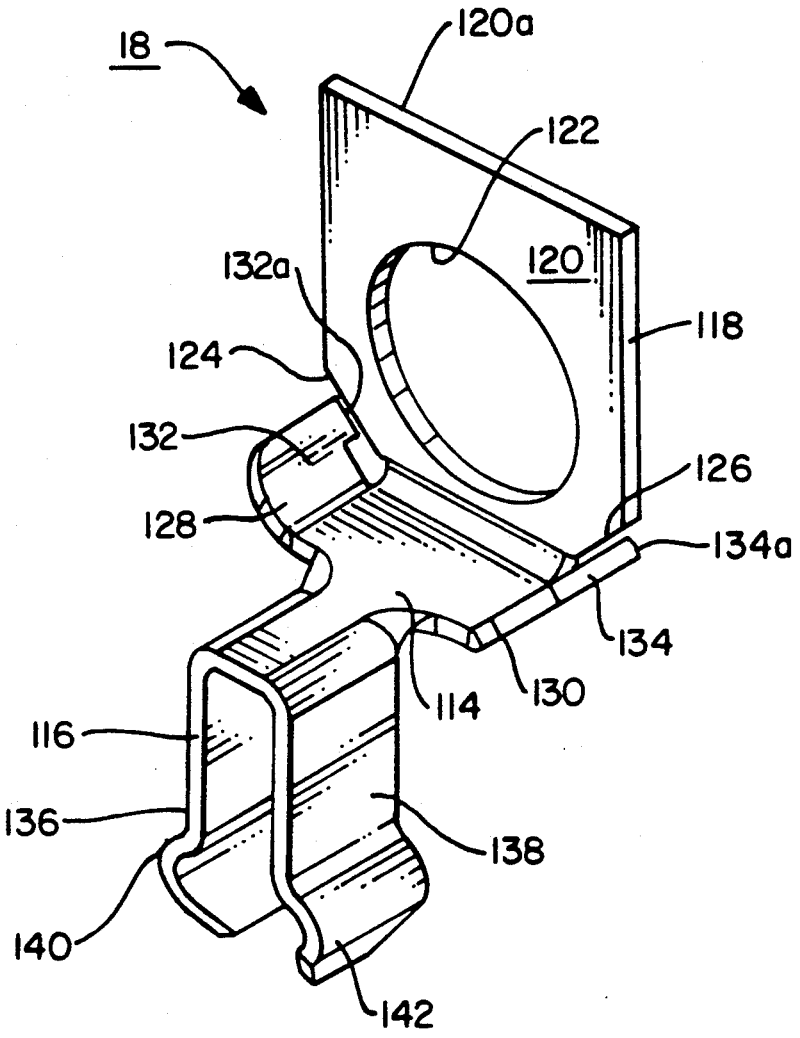
FIG. 6 is a rear, perspective view of a locking clip for particular use in the electrical connector of FIG. 1.
Figure 7:
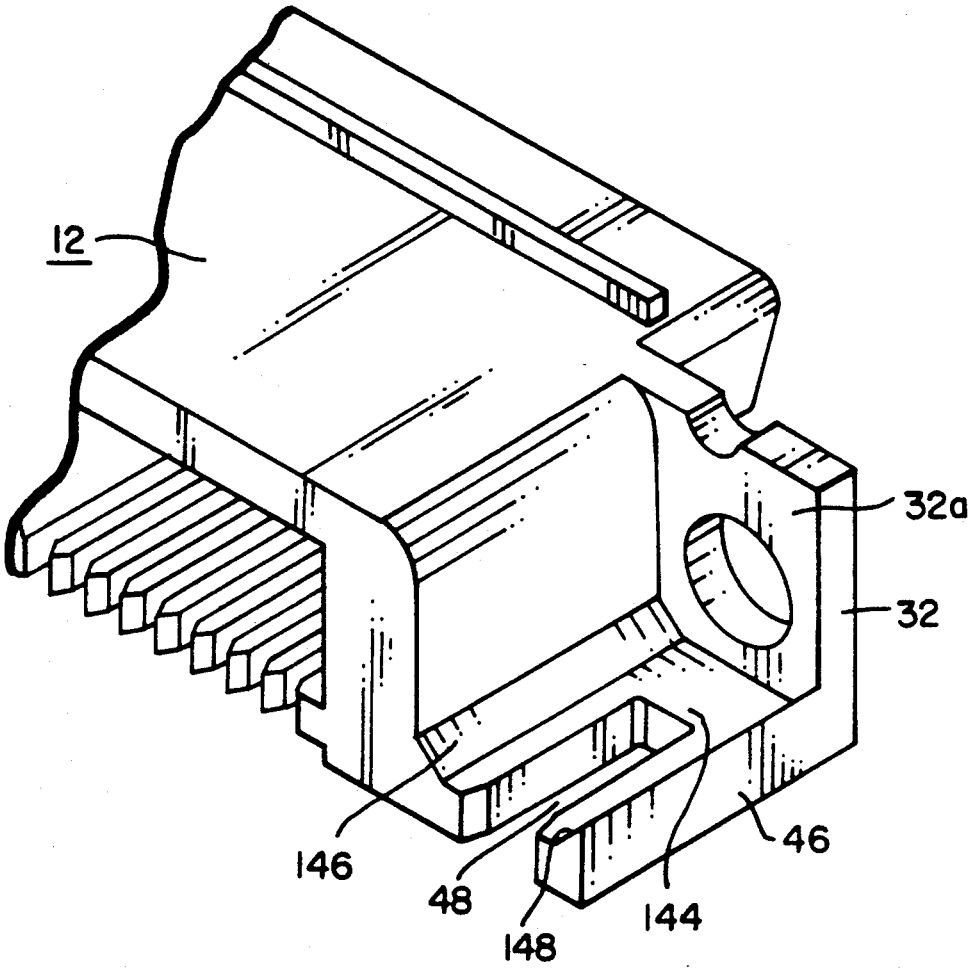
FIG. 7 is a rear perspective view of a fragmentary portion of the electrical connector of FIG. 1, showing details of the connector insulator base on which the locking clip of FIG. 6 is secured.

Turning now to FIGS. 6 and 7 the details of the locking clip 18 are more fully described. Each locking clip 18 is preferably formed of one-piece construction and is stamped and formed from sheet metal, such as phosphor bronze. Each clip 18 is of generally stepped-like shape comprising a generally flat central portion 114, a downwardly depending latching portion 116 and an upwardly extending securement portion 118. The latching portion 116 and the securement portion 118 project in opposite directions at either end of the central portion 114 and are thereby off-set in different vertical planes to define the stepped-like shape.

The securement portion 118 comprises a generally planar flange 120 having a generally circular opening 122 formed therethrough. Toward the bottom of the flange 120 and adjacent the central portion 114 there are formed a pair of opposed angled edges 124 and 126. Projecting outwardly from the flat central portion 114 from each side thereof is a bend-resistant element 128 and 130. Each bend resistant element extends obliquely upwardly relative to the flat central portion 114. Each bend resistant element 128, 130 includes a respective cantilevered extent 132 and 134, each being disposed closely adjacent to a respective angled edge 124 and 126 and intersecting the plane of planar flange 120. Each cantilevered extent terminates in end surfaces, **132*a* and 134*a*, that lie substantially flush with the outside surface 120*a* of the flange 120. The cantilevered extent end surfaces 132*a* and 134*a* are placed to engage the rear surface 32*a* of the mounting wall 32 (see FIG. 7) in use. Such engagement of the extent end surfaces 132*a*, 134*a* with the rear wall surface 32*a* provides resistance to bending of the central portion 114 relative to the flange 120 during insertion of the clip into a printed circuit board to thereby minimize misalignment problems. Referring still to FIG. 6, the latching portion in the preferred arrangement, comprises a pair of spaced, downwardly projecting legs 136, 138, each terminating in a curved end extent 140 and 142** for frictional, resilient retention in a printed circuit board.

As seen more fully in FIG. 7, the base 46 of the insulator 12, as seen from a rearward direction, has an open faced slot defining the opening 48. The base 46 further includes a cradle 144 having a pair of spaced, angled surfaces 146 and 148 upon which the obliquely extending bend resistant elements 128 and 130 are respectively seated. The locking clip 18 is adapted to be slid onto the cradle 144 with the clip legs 136, 138 extending through the open faced slot 48 upon assembly as will be described, with the curved end extents 140, 142 of the clip extending beneath the lower surface of the base 46 in assembly. The surface **120*a* of the clip flange 120, as well as the end surfaces 132*a* and 134*a* of the cantilevered extents are preferably placed against the rear surface 32*a* of the mounting wall when the clip 18 is fully seated in the cradle 144, although such end surfaces 132*a* and 134*a*** may be slightly spaced therefrom.

Having described the details of the constituent components of the electrical connector 10, the assembly thereof is now described. The conductive shell 14 is attached to the insulator 12 with the insulator nose portion 24 inserted into the shell nose portion 54. The rear surface of each of the shell flanges 52 is placed against a front surface of the respective mounting walls 32. As such, the shell recesses 62 and 64 are in substantial registry with the mounting wall recesses 40 and 42, respectively. Similarly, the shell opening 66 is aligned with the mounting wall opening 44. The electrical contacts 20 are suitably inserted from the rear surface of the insulator body 22 into the respective apertures 26, with the contact terminal pins 28 projecting in right angle disposition downwardly from the insulator body 22. Each locking clip 18 is slid onto the body base 46 with the latching portion received in the base slot 48, until the upstanding flange 120 lies against the rear surface **32*a* of each mounting wall 32. The opening 122 in each locking clip flange 120 is aligned in substantial registry with the mounting wall opening 44**.

Each latching block 16 is assembled by inserting the rearwardly extending bushing 106 through the shell opening 66, through the mounting wall opening 44 and through the locking clip opening 122. During such insertion, the upper and lower keying elements 92 and 94 are received in the respective keyways 40 and 42. Due to the offset nature of the keying elements 92, 94 relative to the central axis of the bushing 106, and the cooperative offset arrangement of the recesses 40, 42 relative to the mounting wall opening 44, the latching blocks may be assembled to the connector in only one position. Thus, in this alignment, the latching member 82 has its latching teeth 84, 86 facing outwardly toward each end of the connector. In addition to the desirable alignment, the keying elements and keyways further provide anti-rotation resistance of the latching blocks relative to the insulator 12. Furthermore, due to the offset, s, of the shell flanges 52 relative to the shell frame 50, the side edge 76 of each block 16 lies closely adjacent the frame, which further contributes anti-rotational resistance to the block. Moreover, since the keying elements 92, 94 are located within the periphery of the flat plate of each latching block, the dimensions of the ear portions of the connector may be kept to a minimum.

In this assembly, the rear surfaces 72 of each metal latching block lie against the front surface respectively of each shell flange 52. The thin wall portion 110 of the bushing is then deformed in a conventional peening process whereby the thin wall portion is deformed outwardly and against the rear surface of the locking clip flange 120 in a manner to secure the latching block 16, shell 14, insulator 12 and locking clip 18 together. As such, the locking clip is also in electrical engagement with the latching block and the conductive shell. Thus, electrical connection of the ground clip 18 to a conductive trace on a printed circuit board provides a grounding path to the shell 14. Upon attachment of the connector 10 to a printed circuit board by way of the locking clips 18, bending of the clip 18 is resisted by the bend resistent elements as described hereinabove, thereby providing proper mounting and alignment of the connector on a printed circuit board.

Having described the preferred embodiments of the invention herein, it should be appreciated that variations may be made thereto without departing from the contemplated scope of the invention. With respect to the latching block, for example, although two keying elements have been shown and described, other numbers of keying elements in different shapes and in different locations may be used. With respect to the locking clip, different configurations and numbers of the bend resistant elements may be used. Accordingly, the preferred embodiments described herein are intended to be illustrative rather than limiting. The true scope of the invention is set forth in the claims appended hereto.

I claim:

1. A shielded electrical connector for mounting on a printed circuit board and for attachment to a complementary electrical connector, comprising:

an insulator of insulative material including a body and two spaced ear portions, each ear portion projecting outwardly from said body and comprising a mounting wall having an opening therethrough and a base, said body having a plurality of apertures therein supporting a respective plurality of electrical contacts;

a conductive shell supported on said insulator body and comprising two spaced flanges, each flange having a surface disposed adjacent a respective said insulator mounting wall and having an opening therethrough in substantial registry with a respective said opening in said insulator mounting wall;

two one-piece, metal latching blocks separate from said conductive shell for attachment to a complementary electrical connector, each block being disposed against a respective said flange of said shell, each block comprising a generally flat plate having opposed surfaces, a latching member projecting outwardly from one of said surfaces and in a direction away from said shell flange, and a bushing projecting from said opposite plate surface, said bushing extending through said opening in said shell flange and through said opening in said ear portion mounting wall, said bushing having an internally threaded aperture opening through said surfaces of said flat plate, each said block including a keying element projecting toward a respective said ear portion mounting wall and being in engagement therewith said keying element aligning each block relative to said shell flange and providing anti-rotation resistance, said keying element being spaced from said bushing and lying within the periphery of said mounting wall; and two conductive locking clips supported by said insulator bases, each clip having a securement portion secured to a respective bushing and a resilient latching portion projecting outwardly from said base for resilient mounting to an electrical circuit on a printed circuit board.

2. A connector according to claim 1, wherein each said keying element comprises a keying surface and wherein each said mounting wall has a keyway cooperatively configured to said keying surface and in receipt thereof.

3. A connector according to claim 2, wherein one of said mounting wall openings or said mounting wall keyway is located closer to said insulator body than the other of such openings or such keyways.

4. A connector according to claim 3, wherein each said mounting wall comprises relative upper and lower, spaced, substantially parallel edges and an outer edge joining said upper and lower edges, and wherein said keyway is defined by a recess extending into one of said upper or lower edges.

5. A connector according to claim 4, wherein each said flange on said conductive shell comprises relative upper and lower, spaced, substantially parallel edges disposed adjacent said upper and lower edges of said mounting wall, and wherein one of said upper or lower edges of said shell flanges has extending therein a recess of shape complementary to said recess of said mounting wall and disposed in substantial registry therewith.

6. A connector according to claim 1, wherein said conductive shell comprises a generally flat frame disposed adjacent said insulator body, said respective flanges of said shell being substantially parallel to said frame and offset relative thereto toward said respective mounting walls.

7. A one-piece, metal latching block for use with a separate latching block on an electrical connector for attachment to a complementary electrical connector, comprising:

a generally flat plate having opposed surfaces, a latching member projecting outwardly from one of said surfaces, a bushing projecting outwardly from said opposite surface, said bushing having an internally threaded aperture opening through said surfaces of said flat plate;

at least one keying element projecting outwardly from said opposite surface and being spaced from said bushing, such keying element comprising a keying surface lying within the periphery of said flat plate.

8. A block according to claim 7, wherein said keying surface is non-linear.

9. A block according to claim 8, wherein said plate comprises oppositely spaced, substantially parallel side edges, and oppositely spaced, substantially parallel end edges, said side edges and said end edges defining a generally rectangular shape of said plate surfaces, said bushing being disposed more closely to a side edge and said keying element being disposed more closely to an end edge.

10. A block according to claim 9, wherein said keying element comprises a generally curved keying surface and a generally flat outer surface, said outer surface being disposed adjacent to and within an end edge of said plate and substantially parallel thereto.

11. A block according to claim 10, further comprising a second keying element of like configuration to said keying element, said second keying element being disposed adjacent to said oppositely spaced end edge.

12. A block according to claim 11, wherein said bushing is of generally cylindrical configuration having its central axis projecting substantially perpendicular to said plate, said second keying element being aligned with said keying element in a plane substantially parallel to said side edges, said plane being offset relative to said axis of said bushing.

13. A shielded electrical connector for mounting on a printed circuit board and for attachment to a complementary electrical connector, comprising:

an insulator of insulative material including a body and two spaced ear portions, each ear portion projecting outwardly from said body and comprising a base and a mounting wall, said body having a plurality of apertures therein supporting a respective plurality of electrical contacts;

a conductive shell supported on said insulator body and comprising two spaced flanges, each flange having a surface disposed adjacent a respective said insulator mounting wall;

two one-piece, metal latching blocks for attachment to a complementary electrical connector, each block being disposed against a respective said flange of said shell, each block comprising a latching member projecting outwardly therefrom; and two conductive locking clips supported by said insulator base, each clip having a securement portion attached electrically to said shell and a resilient latching portion projecting outwardly from said base for resilient mounting to an electrical circuit on a printed circuit board, said clip including means providing bend resistance upon mounting said clip to said printed circuit board;

wherein each said locking clip comprises a generally flat central portion from which said securement portion and said latching portion extend in opposite, space apart directions, said securement portion comprising a generally planar flange disposed against said mounting wall and secured to a portion of a respective said latching block; and wherein said bend resistant means comprises at least one bend resistant element projecting outwardly from and obliquely to said central portion, said bend resistant element having an extent spaced adjacent to said securement portion flange, said extent terminating in an end surface adapted to engage a surface of said mounting wall upon bending of said central portion relative to said flange during mounting of said latching portion to said printed circuit board.

14. A connector according to claim 13, wherein said base has an opening therethrough through which said latching portion extends, said base further comprising a cradle having an angled surface for cooperative seating of said obliquely projecting bend resistent element thereon.

15. A connector according to claim 14, wherein said base opening is defined by an open-faced slot, said latching portion of said clip received in said slot in sliding disposition.

16. A locking clip for use in an electrical connector for mounting on a printed circuit board, comprising:

a conductive member having a generally flat central portion and two opposed ends;

a resilient latching portion projecting outwardly from said central portion adjacent one end thereof in a first direction, a securement portion projecting outwardly from said central portion adjacent the other end thereof in a second direction, opposite said first direction, said securement portion comprising a generally planar flange defining a plane; and at least one bend resistant element projecting outwardly from said central portion and intersecting said plane defined by said flange and spaced adjacent to said flange.

17. A clip according to claim 16, wherein said bend resistant element extends obliquely relative to said central portion.

18. A clip according to claim 17, wherein said planar flange comprises a generally planar outside surface, said bend resistant element including a cantilevered extent intersecting said plane and terminating in an end surface lying substantially flush with said outside surface.

19. A clip according to claim 18, further comprising a second bend resistant element of like configuration to said bend resistant element and projecting from said central member generally opposite said bend resistant element.

* * * * *

UNITED STATES PATENT AND TRADEMARK OFFICE

CERTIFICATE OF CORRECTION

PATENT NO. : 5,147,220

DATED : September 15, 1992

INVENTOR(S) : Brent B. Lybrand

It is certified that error appears in the above-identified patent and that said Letters Patent is hereby corrected as shown below:

On cover page, Assignee has been omitted. Should read:

--[73] Assignee: Thomas & Betts Corporation,
Bridgewater, N.J.--

Signed and Sealed this

Twenty-fifth Day of January, 1994

*Attest:*

*Attesting Officer*

BRUCE LEHMAN

*Commissioner of Patents and Trademarks*